United States Patent [19]

Kai

[11] 4,028,833

[45] June 14, 1977

[54] METALLIC TAG

[76] Inventor: Chiharu Kai, No. 3-4, 2-chome, Kita, Koenji, Shuginami, Tokyo, Japan

[22] Filed: June 2, 1975

[21] Appl. No.: 582,824

[52] U.S. Cl. ..... 40/316

[51] Int. Cl.[2] ..... G09F 3/00

[58] Field of Search ..... 40/305, 306, 308, 309, 40/312, 316, 318, 20 R, 21 R, 21 C

[56] References Cited

UNITED STATES PATENTS

| | | | |
|---|---|---|---|
| 274,348 | 3/1883 | Lewis | 40/21 R |
| 936,918 | 10/1909 | Long et al. | 40/21 R X |
| 1,241,302 | 9/1917 | Taylor | 40/316 X |
| 1,407,735 | 2/1922 | Daniel | 40/305 X |

*Primary Examiner*—Louis G. Mancene
*Assistant Examiner*—Mickey Yu
*Attorney, Agent, or Firm*—Wenderoth, Lind and Ponack

[57] ABSTRACT

A metallic tag or label formed from a thin metal plate having an inscribing portion on each side thereof and provided integrally at both ends thereof with bendable edge strips so that the plate can be securely attached to a goods binding means such as a string, band, strap or the like by using said bendable edge strips.

1 Claim, 4 Drawing Figures

METALLIC TAG

SUMMARY OF INVENTION

This invention relates to an improvement in metallic tags or labels used for indicating the sender or receiver, standards, quality, etc., of the goods, baggage or the like.

Heretofore, there have been widely used paper or cloth-made tags or labels, but such tags or labels involve the problem of strength or durability particularly when they are used on certain types of goods. For instance, in case the goods transported is a large-sized and heavy material such as a steel block or hoop, such paper or cloth-made tags or labels can be damaged during loading and unloading or transport of the goods thus making the inscription on the tag illegible. Another defect of such paper or cloth-made tags or labels is that they are easily affected by natural phenomena such as rain or wind and cannot withstand protracted use.

In order to overcome such problems, there have been deviced metal-made tags or labels. Each metal-made tag or label is mostly formed from a thin metal plate provided with small holes at both ends, the affixing wires being passed through said holes. They are the same in construction as said paper or cloth-made tags except for the material from which they are made. However, such metallic tags or labels also have certain drawbacks. For example, when attaching the tag to the goods, it needs to secure said wires to the goods binding string or band by wrenching the wires one by one, so that the tag attaching work is troublesome. Also, the small holes with the wires passed therethrough could rip out during transportation of the goods.

There are also known the metallic tags or labels of the type in which elongated slots are formed in both end faces of the metallic tag plate and a good-binding string or band is passed through such elongated slots to thereby fasten the tag to the goods. Such a type of tag, however, also produces some problems such as the troublesome passing of the binding string or band through the elongated slots, and once the goods are bound, it is no longer possible to attach tag to the goods.

In view of the above, the present invention has for its primary object to provide an improved metallic tag or label which is cleared of the problems of the above-said conventional types of tags or labels, to allow secure affixing of the tag to the goods with an extremely simple method, and which is also tough and strong in its entire structure to minimize the chance of damage to the goods that could be caused during transportation or loading and unloading of the goods.

It is another object of the present invention to provide a metallic tag or label which can be easily manufactured by a press on a mass-production scale at extremely low cost.

In order to accomplish the above-said objects, the metallic tag or label according to the present invention is formed from a single thin metal plate having the inscription portions (for indicating the character, ownership, etc., of the goods) on its obverse and reverse sides. Cutouts are provided along both edges of the plate to form bendable edge strips such that such strips may be fitted onto the binding member such as string or band fastened to the goods, an end of each said strip being bent up or bent down to securely affix said plate, i.e., the tag, to the goods.

Thus, according to the tag or label of the present invention, since it is made in its entirety from a thin metal plate, it shows excellent use characteristics such as high impact resistance and water resistance that can never be achieved with the conventional paper or cloth-made tags. It can also maintain clear indications under all possible strict conditions of use, such as exposure to rain, wind, sun light or impact, thus assuring perfect transport and management of the commodities. Further, the tag affixing work is extremely simplified as compared with the conventional types of tags which are attached by wrenching the wires, and moreover, the tag once attached, can be securely and closely fixed to the binding member, that is, to the goods side, by merely bending an end of each edge strip, thereby eliminating the possibility of damage during transport of the goods.

The time required for affixing the tag is ½ to ⅓ of the time required in the conventional wire wrenching method. This enables a sizable reduction in time and hands necessary, thus realizing and appreciable labor savings. Further, as the tag of the present invention can be made in a single step by a press, it can be manufactured on a mass-production scale at low manufacturing cost.

In order to further clarify the essentials of the present invention, it is now described in detail by way of some preferred embodiments thereof while having reference to the accompanying drawings, in which.

Figure 1:
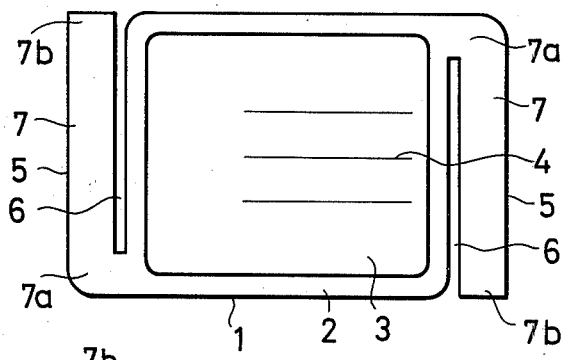
FIG. 1 is a plane view of a tag according to one embodiment of the present invention.
Figure 3:
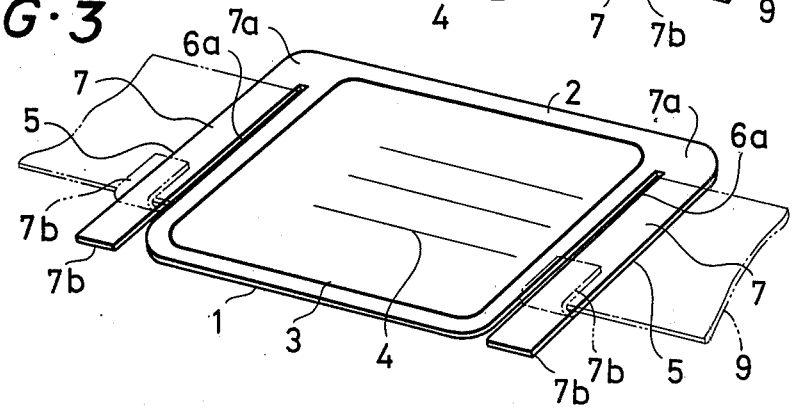
FIG. 3 is a perspective view of another embodiment of the present invention.
Figure 4:
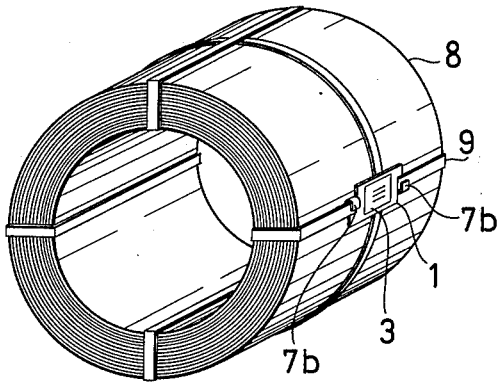
FIG. 4 is a perspective view showing a mode of actual use of the tag shown in FIG. 1.

Referring generally to the drawings, a tag plate 1 is formed from a thin metal plate such as, for example thin steel or aluminium plate which has been subjected to a suitable surface treatment. On each side 2 of said plate 1 is provided an inscription portion 3 having a blank 4 on which the desired inscription can be made. At both ends of the plate 1 are cutouts or slits 6,6 extending parallel to each other along and inside the respective edges 5. The distance from each edge 5 to the associated cutout 6 may be suitably selected. The cutouts 6,6 may be formed by cutting the plate either in the opposite directions to each other as shown in FIG. 1 or in the same direction as shown in FIG. 3 (in which the cutouts are indicated by *6a*, *6a*). It will be noted that the bendable edge strips 7,7 are formed by said cutouts 6,6 (or *6a*, *6a*) at both ends of the plate 1, each of said strips being connected to the plate 1 at its proximal end *7a*. A piece of goods 8 which, in the shown embodiment, is a hoop bound by a binding member 9 which may be band steel, tape, strap or such.

Now a mode of affixing the above-described tag or label to the goods is described with reference to the drawings.

Figure 2:
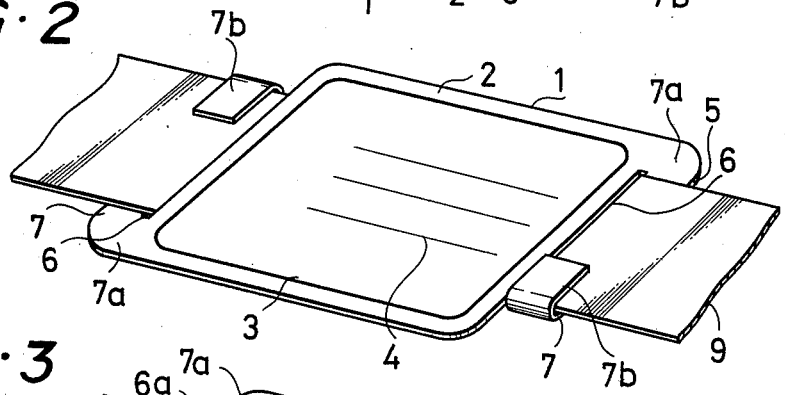
FIG. 2 is a perspective view of the tag of FIG. 1, showing a way of use of the tag.

First the free end of each strip 7 is slightly bent or raised to widen the opening of each cutout portion 6 and then this portion is fitted onto said binding member 9 so as to properly set the tag plate 1 on said member 9 with the inscription portion 3 facing externally as shown in FIGS. 2 and 3, and then the end *7b* of each said strip 7 is bent so as to securely hold the binding member 9 from its upper side as shown in FIG. 2 or as shown by phantom lines in FIG. 3, whereby the tag affixing is completed.

This metallic tag affixing is usually made after the binding member 9 has been fastened to the goods, but it is also possible to affix the tag to the binding member before binding the goods with said binding member. Although a band-shaped strap is used as the binding member 9 in the shown embodiment, such binding member may vary depending on the type of goods to be bound and is of course not limited to the band-shaped strap such as used in the shown embodiment. For instance, when the goods are a columnar or pillar-like blocks such as section steel, thick wire is usually used as binding member 9, and it will be easily understood that the tag or label of the present invention can be very easily affixed to this or any other type of binding member in the same way as described above.

While the present invention has been described in some detail with reference to preferred embodiments thereof, it is to be understood that the invention is not limited to the particular forms of the device shown and described, and that many modifications and changes may be made therein without departing from the spirit and scope of the invention.

What is clamed is:

1. A metallic tag for fitting around a binding, said tag comprising:

a thin, bendable, rectangular metal plate having two spaced, parallel, straight cutout slots therein extending from one edge of said plate partially thereacross, said binding fitting through said slots, and said plate further having bendable edge strips formed between said slots and the edges of said plate adjacent said slots adapted to bend over against said binding fitted through said slots, whereby said plate is secured to said binding; and inscription portion means on said metal plate between said parallel slots for inscribing information thereon.

* * * * *